US006435421B1

(12) United States Patent
Peterson

(10) Patent No.: US 6,435,421 B1
(45) Date of Patent: Aug. 20, 2002

(54) DOLLY TRACK

(75) Inventor: Per V. Peterson, Pasadena, CA (US)

(73) Assignee: Per Peterson, Pasadena, CA (US)

( * ) Notice: Subject to any disclaimer, the term of this patent is extended or adjusted under 35 U.S.C. 154(b) by 0 days.

(21) Appl. No.: 09/653,734

(22) Filed: Sep. 1, 2000

Related U.S. Application Data

(63) Continuation-in-part of application No. 09/022,185, filed on Feb. 11, 1998, now abandoned.

(51) Int. Cl.[7] ..... E01B 23/00
(52) U.S. Cl. ..... 238/10 R

(58) Field of Search ..... 104/89, 93, 104, 104/110; 105/96, 150; 238/10 R

(56) References Cited

U.S. PATENT DOCUMENTS 4,545,303 A * 10/1985 Fujita et al. ..... 104/93
5,601,026 A * 2/1997 Rothmeyer et al. ..... 104/155
6,273,341 B1 * 8/2001 Debabi ..... 238/8

* cited by examiner

*Primary Examiner*—S. Joseph Morano
*Assistant Examiner*—Robert J. McCarry, Jr.

(57) ABSTRACT

A camera dolly track designed for dual purpose use, providing radiused running surfaces for grooved wheeled dollies and a tensioner wheel surface for flat wheeled dollies.

9 Claims, 6 Drawing Sheets

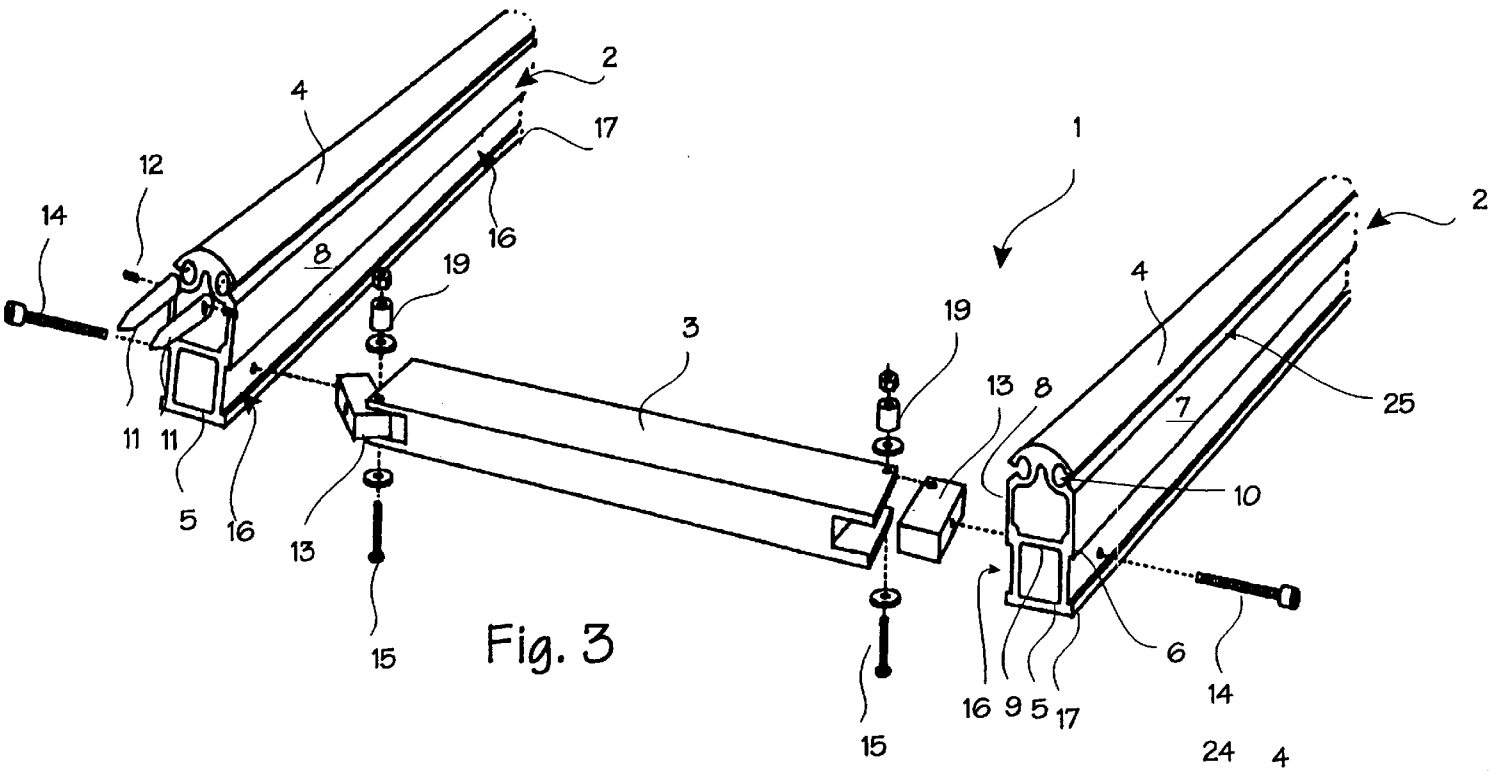
Fig. 3
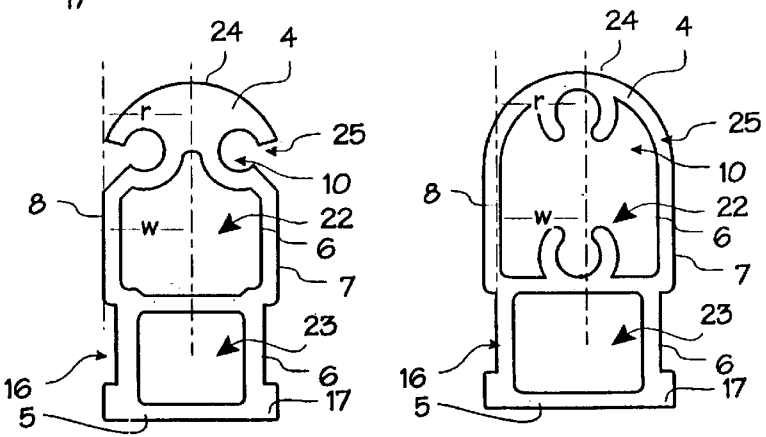
Fig. 4a
Fig. 4

DOLLY TRACK

This is a continuation-in-part of application Ser. No. 09/022,185, filed on Feb. 11, 1998, now abandoned.

FIELD OF THE INVENTION

This invention relates to camera support equipment and tracks for use with camera dollies camera cranes.

BACKGROUND OF THE INVENTION

Camera dollies are heavy wheeled platforms that hold movie cameras and allow for controlled movement of a movie camera during filming of movies, television shows and other productions. Camera cranes also provide smooth movements of the camera, but provide extended reach of the camera. Camera cranes are usually heavier than camera dollies because they require counterweights and ballast to offset the weight of the camera equipment on the extended end of the cantilever arm of the crane. Camera dollies and cranes generally include mechanisms for controlled lifting and/or panning of the movie camera, wheels and steering systems for movement about a set, and a platform for a cameraman to stand on while the camera dolly is moved about the set by a grip. Many camera dollies have wheel systems that will engage a track of one form or another, so that the dollies may be rolled about a set on a track which has been set down to establish a smooth path for the intended movement of the dolly. The track may be laid down anywhere, and may be used to provide level or smooth dolly pathways in indoor studios and outdoor sets such as parking lots, unleveled fields, beaches, streets, hillsides and mountain sides. The inventions described below are aimed at improved tracks for use with a number of standard wheel systems, and the following background sets forth a description of the standard wheel systems necessary to understand the features of the new dolly track.

Clearly, for a camera dolly to run along a track, the wheels and track must be designed to match each other so that the wheels fit on the track and stay on the track. Currently, there are two competing industry standards for matching wheel and track systems. The first system is a combination of a concave wheel which fits onto a matching convex track. The wheel in this system has a concave groove cut down the center of the running surface of the wheels. This concave groove fits over the radiused top of the track and keeps the wheel from falling off the track. (The outer edges of the wheel provide a flat running surface that is used when the dolly is rolled directly on the floor.) The track may be a simple tube mounted on ties, or it may be made of I-beam rails with radiused upper surfaces. In the I-beam cross section, the major vertical structure is the narrow vertical beam (called a web) which is much narrower than the radiused top. This system is used by such dollies as the Chapman PeeWee dolly, the Panther Pegasus dolly, and several other dollies. One type of radiused track is sold under the name of Precision I-Beam track, and is described in detail in the McKie, Rail and Track, U.S. Pat. No. 4,989,782 (Feb. 5, 1991). The second system uses a flat weight-bearing wheel which runs on a flat-topped square track, in combination with a tensioner wheel which hangs down below the running wheel and presses against the vertical side wall of the square track. The tensioner wheel on each running wheel prevents the dolly from slipping off the flat-topped track, and locks the dolly in place cross-wise on the track. This system has a lot of excess friction between the wheel and the track, making it hard to move on the track.

This system is used in dollies manufactured by the J. L. Fisher Co., and the track is also available from the J. L. Fisher Co.

The two types of dolly wheel and track systems are not compatible. Grooved-wheeled dollies cannot be used on flat track, and flat wheeled dollies with tensioner wheels are dangerous when used on radiused track with a centrally arranged vertical wall.

Height and rigidity are important design factors for dolly track. When a camera dolly rides on dolly track, it is several inches higher than when it sits on the floor. For low camera positions, grips must install a lowering plate system. This is time consuming and makes it harder to operate the camera in that position. Thus a shorter track is advantageous in that it limits the need for time consuming installation of lowering plate systems. Height also plays a part in the comfort and natural movement of the actors. Actors occasionally must cross over the track to hit a mark (the position where the director wants him or her to stand). Hidden movement over a 2.5 inch track is unnoticeable on film, while movement over a 4 inch track is very hard to perform with a natural gait, so the fact that the actor is stepping over an off screen obstacle is sometimes apparent.

The current solutions are piecemeal. Regular tube track is just a round pipe that has a sleeper welded on the bottom. The only point of support for the track is at the sleepers, which are provided every few feet along the track. Although tube track may be made with a low profile of about 2.25 inches (6 cm), the problem with this design is that the tube running surface flexes with the weight of the dolly when the dolly is between the sleepers. This creates a porpoise effect, as the dolly passes over peaks and valleys created by the rigid point of track supported by a sleeper, and the flexible portion of the track between the sleepers. This creates an uneven tracking movement and limits the appropriate choices in lens lengths (like driving slowly down the road looking through a pair of binoculars the horizon will be jerking and inconsistent.) Thus stronger, larger track is needed for shots where smooth movement is critical, thus limiting the ability to combine the low shots with smooth movement.

Additionally, tubing is not consistent in tolerance so the mating joints of two pieces of track are very inconsistent and will create a bump at every joint. The tube track system also has problems when you lay it out on a location. The sleepers, which provide the only contact with the ground, are the only place you may level the track. If a sleeper falls in a rut or hole, the track may prove very difficult to level (Box truss and I beam track both have interior sleepers so you can level track anywhere along the bottom surface). The box truss design and the I-beam dolly track are almost 15 to 20 times more rigid than the tube designs, and by being extruded you can guarantee tolerances up to plus or minus a few thousands of a inch, not hundredths like the rolled steel type tube tracks.

SUMMARY

The dolly track disclosed below is unique in that it is the only track that can be used with both flat wheeled dollies and cranes with tensioner wheels and grooved wheeled dollies and cranes with tensioner wheels and grooved wheeled dollies and cranes. The new dolly track has a radiused top to accommodate the grooved wheeled dollies, and it has vertical side walls to accommodate the tensioner wheels used with flat wheeled dollies. The track has a high tolerance coupling system and an overall aluminum box truss design made of 6061 aluminum. The track cross section provides such strength that the track may be made in lower heights than other tracks, eliminating or minimizing the limitations on staging imposed by the height of other tracks. The box truss dolly track of 2.5 inches (about 6.5 cm) is almost as rigid as an I-beam track that is 4 inches (10 cm) high.

BRIEF DESCRIPTION OF THE DRAWINGS

FIG. 3 is an isometric view of a section of another embodiment of the dolly track;

FIG. 4 shows a cross section of the rail of FIG. 3;

FIG. 4*a* shows a cross section of an alternative embodiment of the rail of FIG. 3;

DETAILED DESCRIPTION OF THE INVENTION

Figures 1, 2:
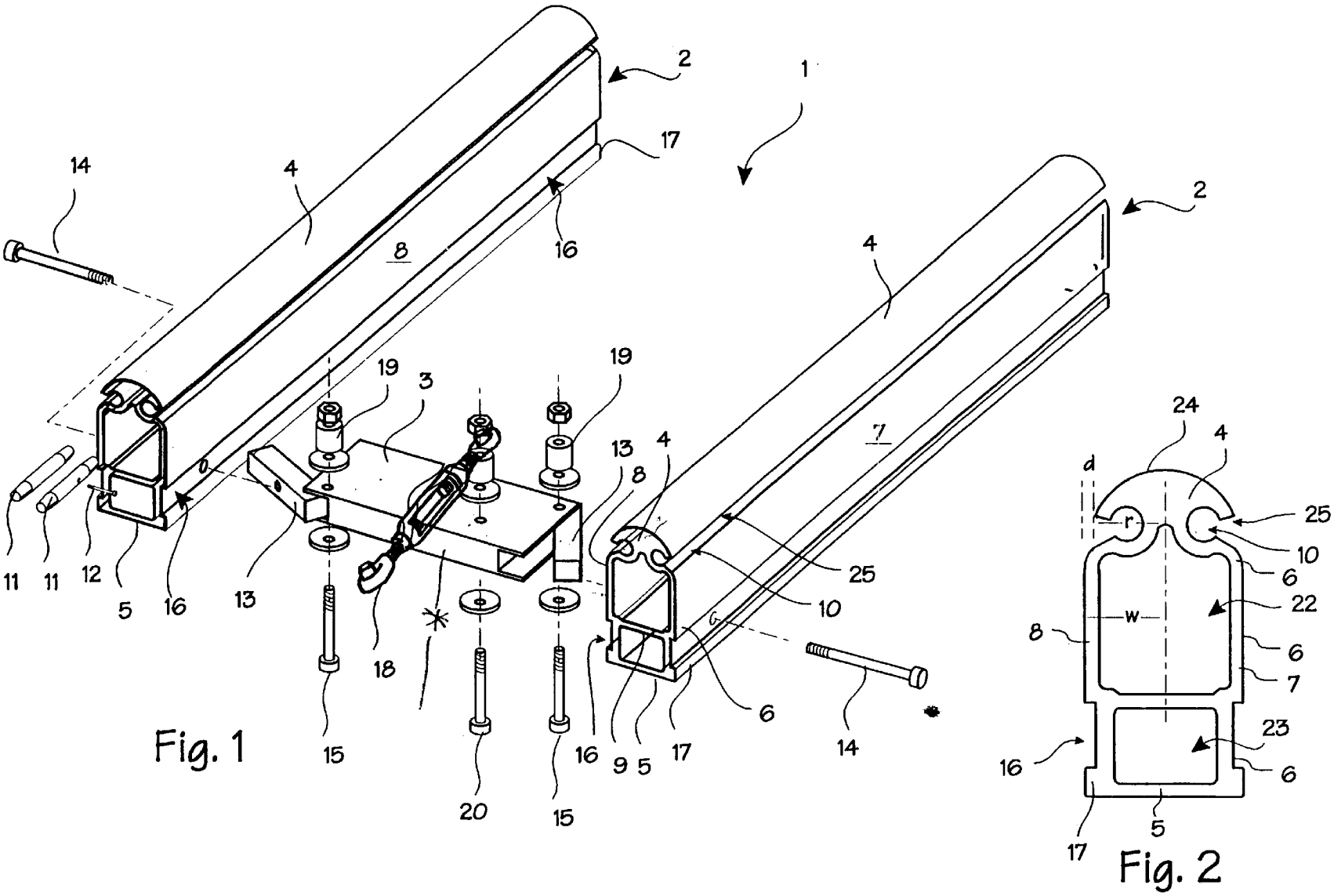
FIG. 1 is an isometric view of a section of the dolly track.
FIG. 2 shows a cross section of the rail of FIG. 1.

FIG. 1 shows an isometric view of the dolly track. The track section 1 comprises two usually co-extensive and parallel rails 2*r* and 2*l*. The rails are held in place relative to each other with the sleepers 3. The sleepers may also be referred to as ties, as they are analogous to railroad ties in keeping the rails in place, and they may also be referred to as spacers or cross members. Several track sections are joined end-to-end to create a long track for a camera dolly. Each rail comprises a rail head 4, a base 5, and a box truss 6 with an exterior side wall 7 and an interior side wall 8 and an interior horizontal strip 9. The truss is an assembly of the members which together form a rigid framework, and includes the base, the horizontal strip, the rail head, and the side walls. Each rail segment includes a longitudinal pin channel 10 which receives an alignment pin 11, so that two rail segments may be butted together and securely aligned by fitting the pins into the pin channels in each of the rail segments to be joined. The track is more stable and better aligned when two such pin and channel locking mechanisms are provided in each rail, as shown in FIG. 1. In this embodiment the pin channels 10 are aligned laterally to the center line of the rails, and in horizontal alignment, but they may also be arranged on the centerline of the rails in vertical alignment. Although the alignment pins are preferably very tight fitting within the pin channels, set screws (called grub screws) 12 are usually provided to so that the alignment pins may be further secured by driving the set screw against the interior wall of the pin channel.

It is generally helpful to make the track so that it is adjustable for various width dolly wheel bases, and also collapsible for storage and transport. For this purpose, the sleepers are secured to the track with hinges. In FIG. 1, the hinge blocks 13*l* and 13*r* are secured to the rails with bolts 14, and the sleepers are secured to the blocks with rotatable bolt assemblies 15*l* and 15*r*. The rotating bolt assemblies of the left and right blocks are placed in apposition to each other to allow the track segment to scissor closed. The hinge of block 13*l* is located on the rear of the block, while the hinge of block 13*r* is placed on the front of the block. By scissoring closed, the track may be narrowed to provide a narrower track, or it may be scissored completely closed for storage.

The wide channel 16 is referred to as the sleeper channel. The sleeper channel is defined by the foot 17 which itself comprises a small lateral extension from the track body near the bottom of the track, and by the lower edge of the interior vertical side wall 8 of the rail. The sleeper channel assists in proper placement of the blocks during manufacture and frequent re-assembly required during normal use. The sleeper channel also provides a resting channel for the sleepers when the track is scissored closed into its fully closed position. The corresponding channel in the exterior wall 7 is provided to ease the difficulty of production. Because the rails are extruded from aluminum, the symmetrical cross section provided by the exterior cross section eases the extrusion process and permits manufacture of track to higher tolerance than comparable extrusion of an asymmetrical cross section.

Each segment of track can be further secured to the next track segment with turnbuckles or clasps 18 which reach from the last sleeper on the first track section to the first sleeper on the next section of track. In prior art systems, the turnbuckles are attached to the sleepers via the same bolts used for the hinge block hinge pins, attached to lugs 19. As shown in FIG. 1, the turnbuckles in this new track design are secured to the sleepers with bolts 20 and lugs 21 located several inches inboard of the rails, toward the center of the track segment.

FIG. 2 shows a cross section of the rails used in FIG. 1. The rail 2 has a symmetrical cross section, and the cross section of the left and right rails are the same. The box truss section 6 includes the interior side wall 8 and exterior side wall 7, the base 5 which joins the side walls at the foot of the rail, and the horizontal interior strip 9 which joins the side walls near the vertical center of the rail. The top of the box truss section is provided by the rail head 4. The box truss design may also be described as a multi-bore design, with the upper bore 22 and lower bore 23 provided to make the track lighter, vis-a-vis a solid rail having the same outer profile. The rails may be made in a solid extrusion, although this would make them heavier and costlier than necessary, it would provide increased rigidity that may be necessary under extremely heavy camera cranes.

The pin channels 10 are located in the rail head, where the rail head meets the box truss section 6. The rail head 4 provides the running surface and weight bearing surface upon which the dollies wheels will rest. The rail head has a radiused upper surface 24. The rail head in this embodiment extends downwardly to terminate just above the interior side wall 8 and exterior side wall 7, leaving a lengthwise gap 25 which provides access to the pin channels 10. Below the pin channels, in the box truss section 6, the interior side wall 8 extends outwardly beyond the width of the rail head 4, and extends downwardly to form the upper lip of the sleeper channel 16 (The exterior side wall 7 has the same shape, making the rail symmetrical, so that there are no distinct left or right rails in this embodiment). The interior side wall 8 provides the running surface for the tensioner wheels in flat wheel dolly systems.

At the base, the foot 17 extends laterally from the rail to define the lower extent of the sleeper channel 16. The curvature of the radiused upper surface of the rail head is chosen to match standard grooved or split dolly wheels. Additionally, the width w from the rail vertical centerline to the outer surface of the interior side wall is chosen to match the standard tensioner wheel distance of standard flat dolly wheels. Given current standards in the industry, the interior side wall extends about ⅛ to ¼ inch (about 3–6 mm) wider than the radiused upper surface, as shown by the distance d in FIG. 2. This extra width in the interior side wall is necessary to accommodate flat wheeled dollies on curved sections of track. It maintains the flat wheels centered over the radiused surface, and prevents the dolly from side-slipping on curved track.

The track rails may be made in various heights, but it is generally better to have the lowest profile track. The track rails of FIG. 1 are preferably 3 inches high (about 7.5 cm). While the track may be much lower, 3 inches provides for clearance of the tensioner wheels above the sleeper bolts when used with the flat wheeled systems.

FIG. 3 shows another embodiment of the track. All the parts correspond to the parts discussed in relation to FIG. 1. The rails are only 2.5 inches high (about 6.5 cm), and the interior side wall is co-extensive with the radiused top. FIG. 4 shows a cross section of the embodiment. The width w is coextensive with the width r of the radiused top. Thus, the portion of the rail between the rail head and the foot is about the same width as the rail and the foot. This embodiment is fine for straight tracks used with flat wheel systems, but is not ideal for use with currently available Fischer dollies when used on curved track. FIG. 4*a* shows a cross section of rail where the pin channels are arranged vertically within the box truss section of the rail.

Figure 5:
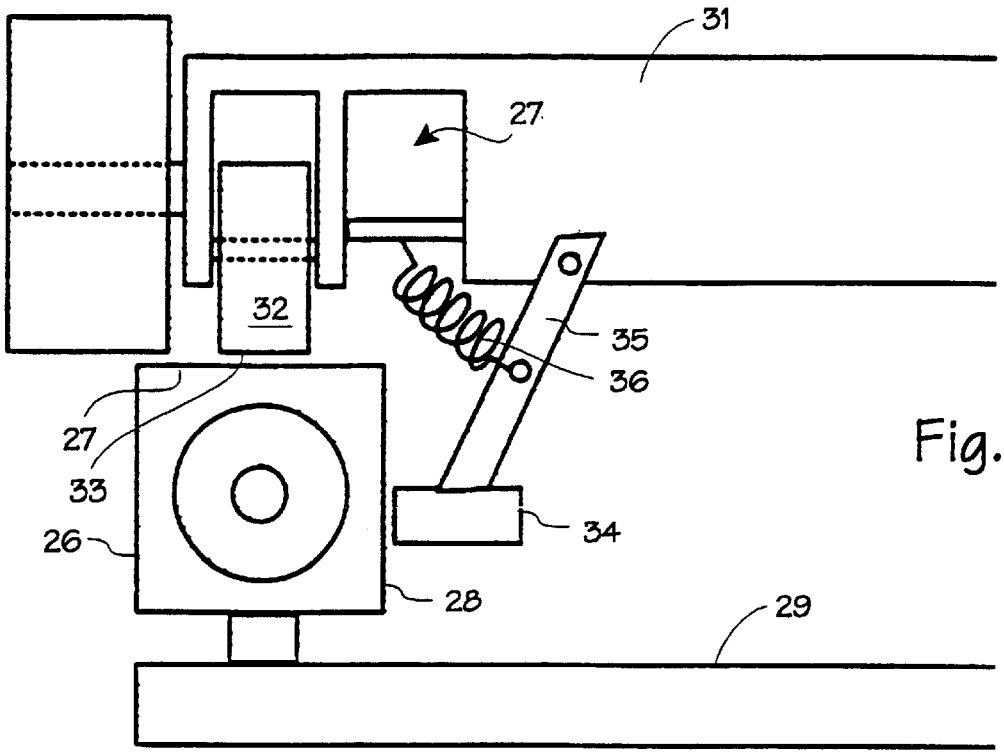
FIG. 5 shows an end view of a section of square track with a flat wheel dolly on the track.

FIG. 5 shows an end view of the prior art square track with a Fisher flat wheeled dolly on the track. The square track includes a square rail section 26 with a flat top surface 27, and a vertical interior side wall 28. The rail rests on an occasional sleeper 29. The flat wheel system 30 is attached to the dolly chassis 31 (the remainder of the dolly is not shown). The flat wheel 32 has a flat tread 33 which rests directly on the flat top surface 27. The chassis holds an additional tensioner wheel assembly which includes the tensioner wheels 34, the tensioner wheel arm 35, and the tensioner wheel spring 36. While the dolly is on the track, the tensioner wheel is pulled down to the position inside the track so that the wheel rolls on the interior side wall 28. This is the only mechanism provided for keeping the dolly from rolling off the track (When the dolly is not on a track, the tensioner wheel is housed in the recess 37 in the chassis.

Figure 6:
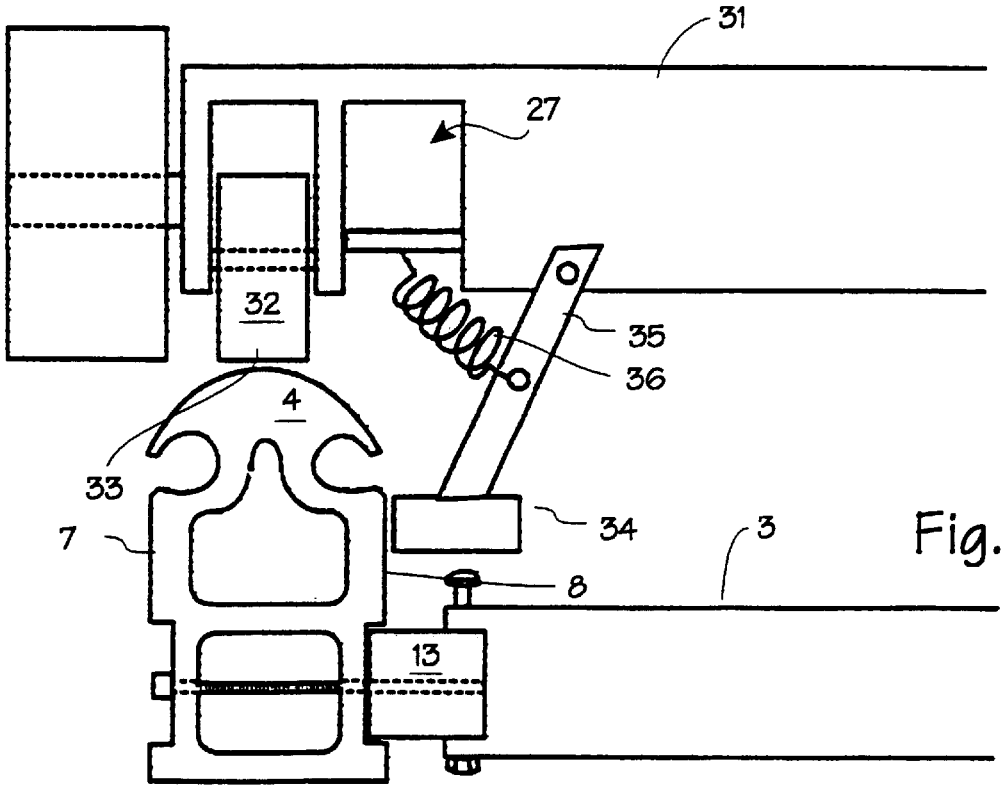
FIG. 6 shows an end view of a section of new track with a flat wheel dolly on the track.

FIG. 6 shows the old flat wheel system running on the new radius top track. The traditional flat wheel 32 supports the weight of the dolly and rides along the crown of the radius top 4 of the rail 2. The tensioner wheel 34 rides along the interior side wall 8, and thereby locks the dolly in place on the track. The sleeper 3 is shown connected to the rail via the block 13. The track has proven to work very well without the flat running surface previously thought necessary for use with flat wheels. In this manner, popular flat wheeled dollies such as those available from J. L. Fisher Co. may be used on the new track.

Figure 7:
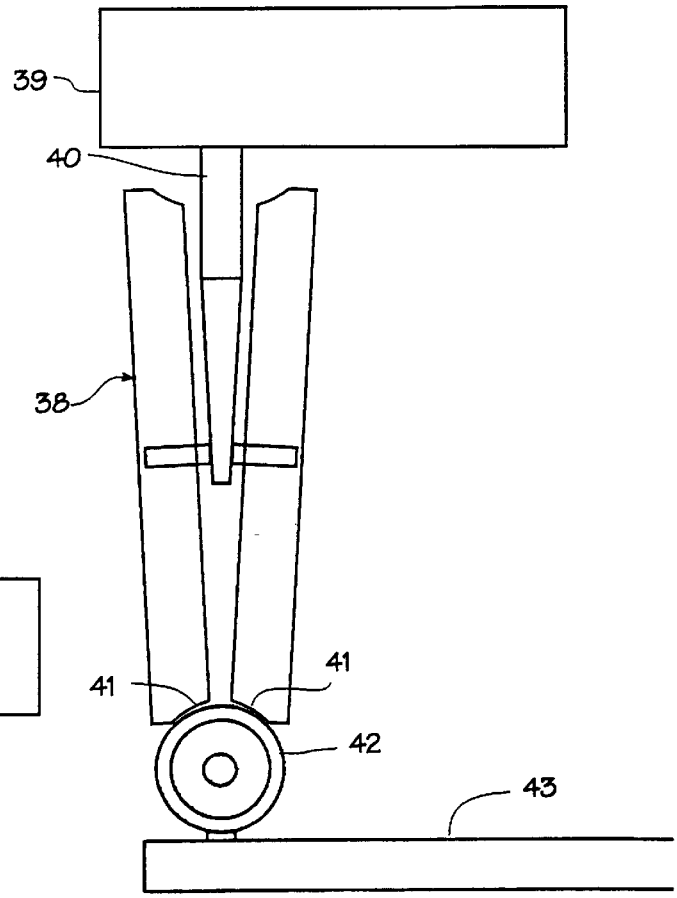
FIG. 7 shows an end view of a section of tube track with a grooved wheel dolly on the track.
Figure 8:
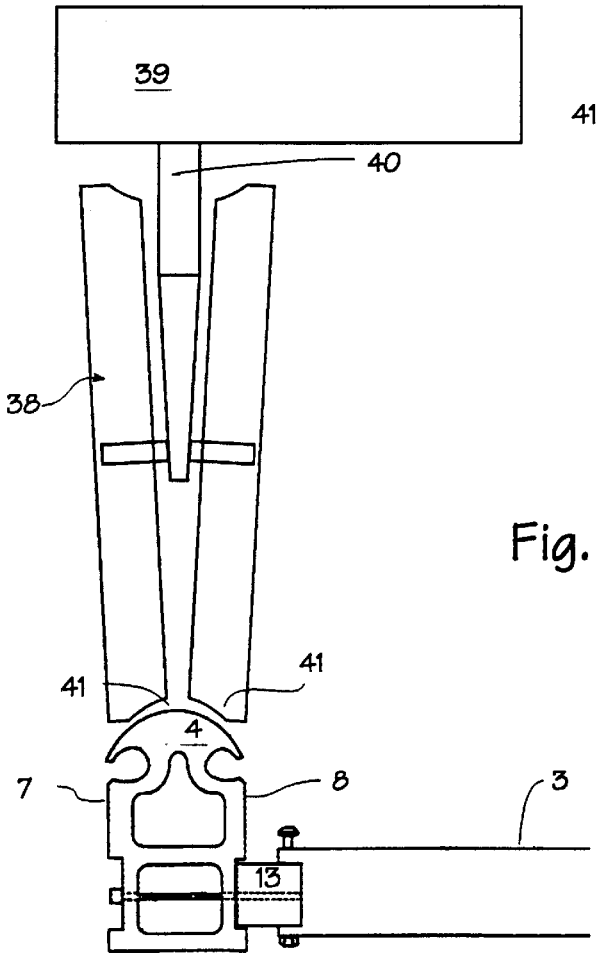
FIG. 8 shows an end view of a section of new track with a grooved wheel dolly on the track.

FIG. 7 shows the combination of a grooved track wheel with a standard tube track. The grooved wheel 38 depicted is a split wheel similar to that used on Cineccanica dollies and Leonard Studios dollies. Single part grooved wheels are used on a variety of other dollies. The grooved wheel is mounted on the dolly chassis 39 with the king pin 40 as shown, or with a simpler axle like the axle shown in the flat wheel assembly of FIG. 5. The groove 41 of the grooved wheel fits over the tube, allowing the wheel to track over the tube while at the same time locking the wheel against any lateral movement (this means that the tensioner wheel used in the flat wheel systems is not necessary). The tube track consists of the tubular rail 42 and occasionally spaced sleepers 43. FIG. 8 shows the same grooved dolly wheel riding on the new track, with the groove 41 of the wheel matching the radiused top of the rail 2.

Figure 9:
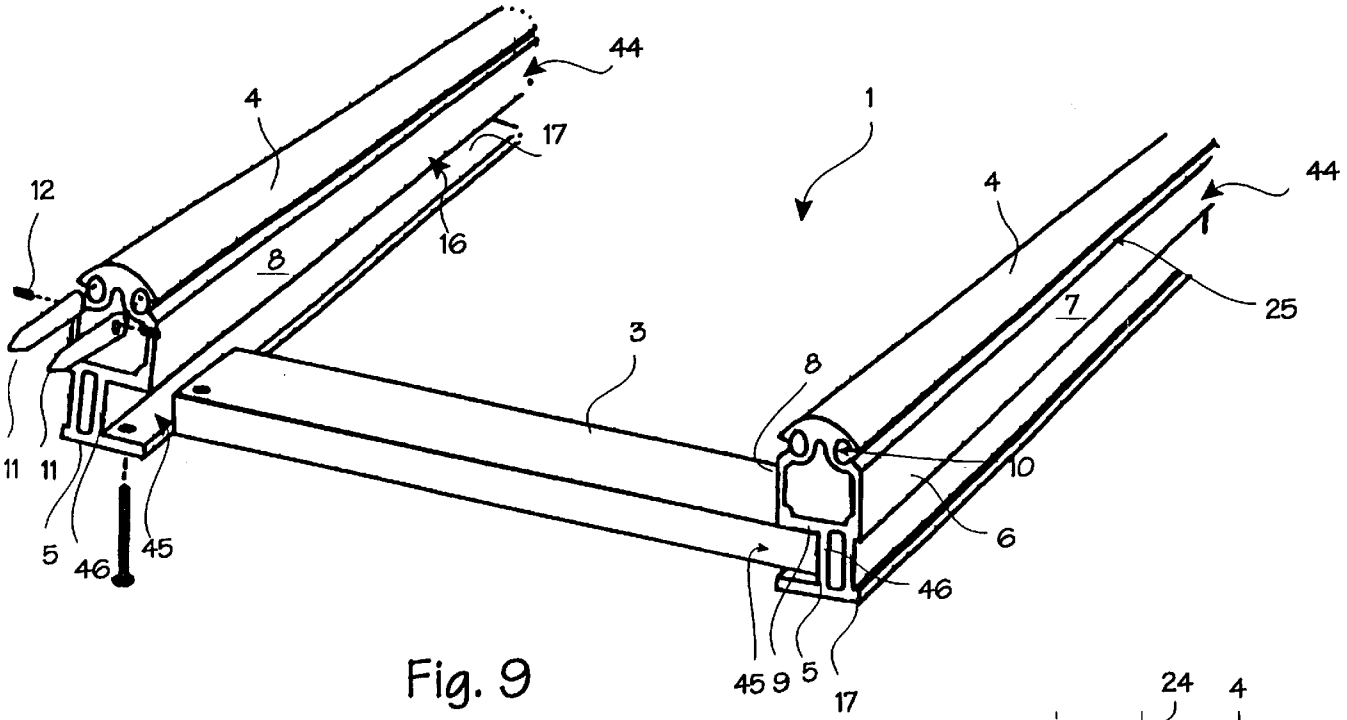
FIG. 9 is a isometric view of an alternative embodiment of the new track.
Figure 10:
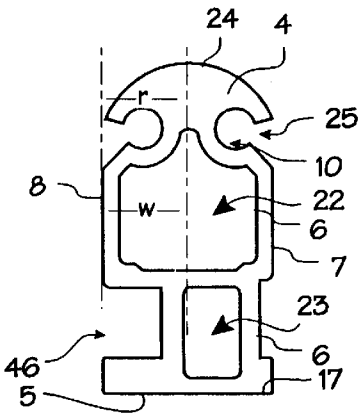
FIGS. 10 and 11 are cross sections of an alternative embodiments of the new track.
Figure 11:
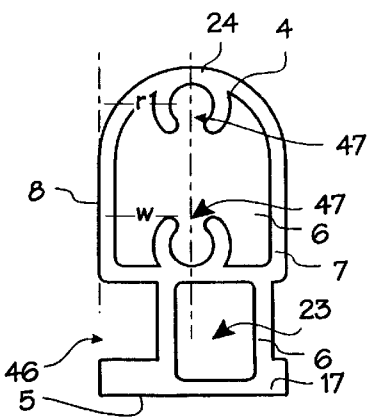

FIG. 9 shows a section of track 1 with rails 44 having a cross section that does not require sleeper blocks, and FIG. 10 show a corresponding cross section of this modified rail. The sleeper channel 46 is much deeper than on the rails shown in the previous figures, and permits the sleepers 3 to be secured directly to the rails with bolts 15. The channel portion 46 of the vertical side wall is set deep within the rail, near the vertical mid-line. FIG. 10 includes lateral pin channels 10 used for alignment and securing of track segments. FIG. 11 shows a similar embodiment, with vertically aligned pin channels 47 provided on the interior of the truss section 48.

Figure 12:
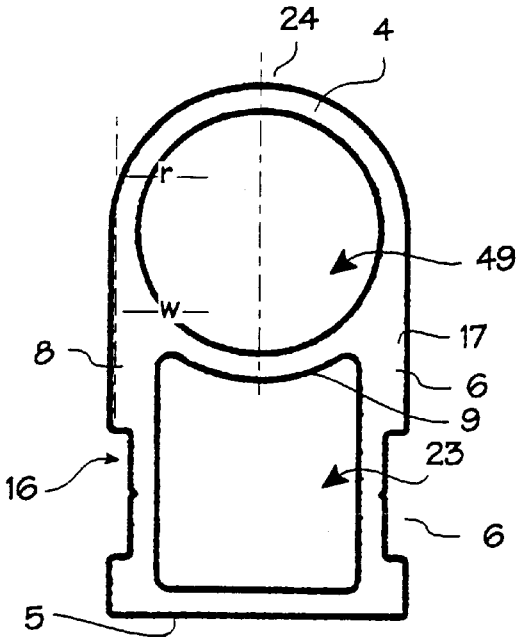
FIGS. 12 and 13 are cross sections of an alternative embodiments of the new track.
Figure 13:
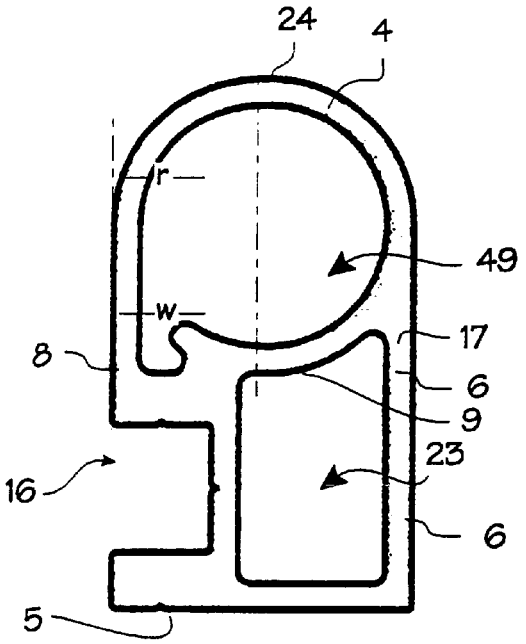

FIGS. 12 and 13 illustrate the cross section of the new track design as applied to dolly track systems which use a single large alignment pin coupling system in lieu of the alignment pins illustrated in the previous figures. These systems use a single large internal bore 49 which receives a plug of matching diameter. The plug fits into the bore of two successive lengths of track to secure the track sections together. The rail cross section in this embodiment retains the features of the earlier figures, including the radiused top rail head 4, the vertical interior side walls 8 extending downwardly at substantially the same distance from the vertical centerline as required to create a running surface for a flat wheel system tensioner wheel, the foot 5 and the box truss section 6, the sleeper channel 16, and the interior horizontal strip 9. The horizontal strip of FIGS. 12 and 13 are made by the lower arc of the large bore 49. In cross section, this tubing should not be confused with traditional tube railing because the box truss section is longitudinally co-extensive with the rail head.

The rails described above are most conveniently made by extrusion, although other methods may be used. The rails are preferably made of aluminum, specifically alloy 6061. Prior art rails and tube have been made of other alloys which do not permit the exact tolerance which has unexpectedly been achieved with the use of alloy 6061. The rails made of alloy 6061 have been made to tolerances of a few ten thousandths of an inch, and this fine tolerance results in much better alignment of the track sections. Some variation in the commercial embodiments are to be expected. Two rails in a track section will usually be used in a parallel condition, including curved sections of track in which the rails are parallel around the curve, and the track has been described with this normal condition in mind. In some instances, the rails may not be parallel, as permitted by use of the pivoting hinge blocks. The current industry standards of grooved track wheels and flat track wheels are accommodated with the designs, so that the rail head is described as convex with these standards in mind. However, the rail head may be made with a concave upper surface, and matched with round profile track wheels (round referring to the tread, and not the side view of the wheel which must be round to make it a wheel). Also, some currently available track could be modified to incorporate the inventions described above, without necessarily incorporating each and every inventive aspect.

For example, I-beam track can be modified with the addition of an interior side wall to provide a running surface for tensioner wheels of the flat wheeled systems.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

What is claimed is:

1. A rail for use in a track for a camera dolly or a camera crane having either conventional grooved wheels or conventional flat wheels, said rail comprising:

a rail head having a substantially radiused top surface that would mate with a conventional grooved dolly wheel; said rail head having a pair of laterally spaced edges, for reference purposes one of said edges is referred to as an interior edge and said other edge is referred to as an exterior edge; said rail head having a vertically extending centerline axis that would align with a vertical centerline of a conventional grooved camera dolly wheel; said rail head having a bottom end; said lateral distance between said vertical centerline axis and said interior edge of said rail head is equal to a distance (r);

extending downwardly from and connected to said bottom end of said rail head are a pair of laterally spaced side walls each having an outer surface; for reference purposes one of said side walls is referred as an interior side wall and said other side wall is referred to as an exterior side wall; said lateral distance between said vertical centerline axis and said outer surface of said interior side wall is equal to a distance (w) and (w) is at least equal to or greater than (r);

a base and said interior side wall extends down to and is connected to said base;

at least one longitudinally extending pin channel formed in said rail head adjacent its bottom end for receiving an alignment pin that would allow two rail segments to be butted together and securely aligned by fitting a pin into the pin channel and each of the rail segments to be joined; and said rail having been formed by an extrusion process with a longitudinally extending upper bore and a longitudinally extending lower bore that are vertically spaced from each other by an interior horizontal strip thereby forming a rigid truss framework.

2. A rail for use in a two rail track for a camera dolly or camera crane having either conventional laterally spaced grooved wheels or conventional laterally spaced flat wheel assemblies which include flat track wheel that travels on the top surface of a rail head and a tensioner wheel capable of exerting lateral force against an interior side wall of the rail, said rail comprising:

a rail head having a substantially radiused top surface that would mate with a conventional grooved camera dolly wheel; said rail head having a pair of laterally spaced external side edges, for reference purposes one of said side edges is referred to as an interior side edge and said other side edge is referred to as an exterior side edge; said rail head having a vertically extending centerline axis that would align with a vertical centerline of a conventional grooved camera dolly wheel or a conventional flat track camera dolly wheel; said rail head having a bottom end; said lateral distance between said vertical centerline axis and said interior side edge of said rail head is equal to a distance (r);

extending downwardly from and connected to said bottom end of said rail head are a pair of laterally spaced side walls each having an outer surface; for reference purposes one of said side walls is referred as an interior side wall and against said outer surface of said interior side wall a tensioner wheel of a conventional camera dolly flat wheel assembly would exert lateral force to keep its flat track wheel centered over said centerline axis of said rail head and said other side wall is referred to as an exterior side wall; said lateral distance between said vertical centerline and said outer surface of said interior side wall is equal to a distance (w) and (w) is at least equal to or greater than (r); and a base and said interior side wall extends down to and is connected to said base.

3. A rail for use in a track for a camera dolly or camera crane having either conventional grooved wheels or conventional flat wheels as recited in claim 2 wherein said rail has been formed by an extrusion process with a longitudinally extending upper bore and a longitudinally extending lower bore that are vertically spaced from each other by an interior horizontal strip thereby forming a rigid truss framework.

4. A pair of rails as recited in claim 2 aligned in parallel relationship to each other with their respective interior side walls facing each other and means rigidly connecting said rails together to form a track.

5. A pair of rails as recited in claim 4 wherein said means rigidly connecting said rails together are members known in the industry as sleepers.

6. A rail for use in a two rail track as recited in claim 2 wherein the height of said rail is always in the range of 1.5–4.5 inches.

7. A rail for use in a two rail track as recited in claim 2 wherein said rail has at least two longitudinal pin channels for receiving alignment pins so that two rail segments may be butted together and securely aligned; said pin channels being laterally spaced from each other on opposite sides of the vertical centerline axis of said rail.

8. A rail for use in a two rail track as recited in claim 2 wherein said rail has at least two longitudinal pin channels for receiving alignment pins so that two rail segments may be butted together and securely aligned; said pin channels being vertically spaced from each other and being substantially on the vertical centerline axis of said rail.

9. A rail for use in a two rail track as recited in claim 2 further comprising a sleeper reception channel in said interior side wall.

* * * * *